US010619526B2

(12) United States Patent
Christgen et al.

(10) Patent No.: US 10,619,526 B2
(45) Date of Patent: Apr. 14, 2020

(54) VARIABLE VALVE TRAIN OF A COMBUSTION ENGINE

(71) Applicant: Schaeffler Technologies AG & Co. KG, Herzogenaurach (DE)

(72) Inventors: Wolfgang Christgen, Seukendorf (DE); Volker Schmidt, Burgbernheim (DE); Matthias Becker, Herzogenaurach (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 44 days.

(21) Appl. No.: 15/992,770

(22) Filed: May 30, 2018

(65) Prior Publication Data

US 2018/0363517 A1 Dec. 20, 2018

(30) Foreign Application Priority Data

Jun. 19, 2017 (DE) ..... 10 2017 113 363

(51) Int. Cl.

| | |
|---|---|
| ***F01L 1/34*** | (2006.01) |
| ***F01L 13/00*** | (2006.01) |
| ***F01L 1/18*** | (2006.01) |

(52) U.S. Cl.

CPC ..... *F01L 13/0015* (2013.01); *F01L 1/182* (2013.01); *F01L 1/185* (2013.01); *F01L 13/0005* (2013.01); *F01L 13/0036* (2013.01); *F01L 2001/186* (2013.01); *F01L 2013/001* (2013.01); *F01L 2013/103* (2013.01); *F01L 2105/00* (2013.01); *F01L 2800/06* (2013.01); *F01L 2800/10* (2013.01)

(58) Field of Classification Search

CPC ..... F01L 13/0015; F01L 13/0005; F01L 13/0036; F01L 1/182; F01L 1/185; F01L 2800/06; F01L 2800/10; F01L 2001/186; F01L 2013/001; F01L 2013/103; F01L 2105/00

See application file for complete search history.

(56) References Cited

U.S. PATENT DOCUMENTS

| | | | | |
|---|---|---|---|---|
| 6,314,928 | B1 * | 11/2001 | Baraszu | F01L 1/185 123/90.16 |
| 8,869,772 | B2 * | 10/2014 | Hisaminato | F01L 1/34 123/321 |
| 2012/0290197 | A1 * | 11/2012 | Kogo | F01L 1/344 701/104 |

FOREIGN PATENT DOCUMENTS

| | | |
|---|---|---|
| DE | 4226798 | 2/1994 |
| WO | 9518917 | 7/1995 |
| WO | 2015181264 | 12/2015 |

* cited by examiner

*Primary Examiner* — Zelalem Eshete
(74) *Attorney, Agent, or Firm* — Volpe and Koenig, P.C.

(57) ABSTRACT

A variable valve train (1) of a combustion engine for applying a load on two equally acting gas exchange valves (2, 3) for each cylinder of the combustion engine is provided, including a switchable valve train element (4, 5) with an outer part and an inner part ((6, 7), (8, 9)) that can move relative to each other allocated to each of the two gas exchange valves (2, 3). The outer and inner parts ((6, 7), (8, 9)) are selectively connectable to each other by an associated coupling slide mechanism (10, 11). The valve train (1) further includes a control shaft (12), on which a control cam (13, 14) is applied for each coupling slide mechanism (10, 11), and the control cams contact an outer end face (15, 16) of the respective coupling slide mechanisms (10, 11) for displacement thereof in one direction, and the two control cams (13, 14) can rotate separately from each other on the common control shaft (12).

12 Claims, 2 Drawing Sheets

VARIABLE VALVE TRAIN OF A COMBUSTION ENGINE

INCORPORATION BY REFERENCE

The following documents are incorporated hereon by reference as if fully set forth: German Patent Application No. 10 2017 113 363.1, filed Jun. 19, 2017.

BACKGROUND

The invention relates to a variable valve train of a combustion engine for applying a load to two equally acting gas exchange valves for each cylinder of the combustion engine, wherein a switchable valve train element with an outer part and an inner part that can move relative to each other is allocated to each of the two gas exchange valves, wherein these parts can be selectively connected to each other by means of an associated coupling slide mechanism, so that when they are coupled, a large travel and when they are decoupled, a relatively smaller or zero travel of the gas exchange valve is realized, wherein the valve train further comprises a control shaft on which a control cam is applied to each coupling slide mechanism, and this control cam at least indirectly contacts an outer end face of its coupling slide mechanism for its displacement in one direction.

A valve train according to the class is disclosed in WO 2015/181264 A1. This is described as a variable finger lever drive for valve lift switching. A group of two equally acting gas exchange valves of a cylinder is here equipped with identical finger levers. Each of the finger levers has, for its support element-side end, a piston extending past this end as a coupling slide mechanism. A control cam of a control shaft is allocated to each piston, wherein this control shaft can be rotated by an electric motor. The two control cams do have a rigid arrangement on the control shaft but are offset in phase relative to each other. By rotating the control shaft in one direction, ultimately 4 lift modes and thus 4 total gas exchange cross sections can be achieved for each cylinder.

A disadvantage in the prior art specified above, however, is the "rigid" and non-variable sequence of the switching states. Thus, in the worst case, for example, in the event of abrupt load changes in the combustion engine, the control shaft must first "switch" "step-by-step" until it reaches the desired switching states.

SUMMARY

The objective is therefore to create a valve train without the disadvantages described above. In particular, a valve train should be created that offers improved switchability between its cam lifting steps.

This objective is achieved according to the invention in that two control cams can rotate separately from each other on the common control shaft.

Thus, it is possible without great complication to switch between, e.g., 4 cam lift modes without intermediate steps in the switching process. Optionally, more than two equally acting gas exchange valves, e.g., three, could also be provided for each cylinder with a variable valve train element or the latter could also act simultaneously on more than one gas exchange valve, wherein a correspondingly enlarged contact surface has proven necessary for this purpose.

Here, "equally acting" is understood to mean that the valve train is provided for actuating at least two intake valves or at least two exhaust valves of a cylinder. It is obvious that different lifting travels could also be realized from valve to valve in a cylinder, such as a) according to the Miller principle and b) according to the Atkinson principle or that the corresponding other group of gas exchange valves can also be generally switched.

The valve train according to the invention can be used in one-cylinder or multiple-cylinder combustion engines, e.g., for internal exhaust gas recirculation on the outlet valve side or, stated simply, for dethrottling on the intake valve side. In a multiple-cylinder combustion engine, it is also conceivable and provided to "equip" only a part of the cylinders with the switching components, so that cylinders with a standard valve train layout can remain, which might help to reduce costs. It is also possible by means of the measures according to the invention to deactivate a part of the cylinders of a combustion engine completely, while maintaining the ability to switch the total valve opening cross sections for the remaining cylinders. This is realized by the use of different valve train elements.

As the switchable valve train element, a rocker arm, pivot arm, or finger lever can be used as a switchable cam follower. As an alternative to this element, e.g., a bucket tappet or a support element for a finger lever is possible. The necessary control shaft runs preferably parallel to the camshaft direction and can be integrated directly in the cylinder head or arranged to the side and in front.

The shaft parts of the control shaft "nested one inside the other" according to one especially preferred refinement of the invention are each loaded separately by a servo mechanism such as an electric rotary actuator or pivoting actuator. Thus, only two actuators, which could also operate hydraulically, are required for a combustion engine. However, it is also conceivable and provided to allocate a separate control shaft each with two actuators for each cylinder or cylinder group of the combustion engine.

The actuators can sit on the ends of the control shaft. For reasons of installation space or with respect to reducing the influence of the torsional suppleness of the control shaft, the actuators could also engage the shaft, e.g., in the middle.

In addition, it is proposed, especially for multiple-cylinder combustion engines, to allow each coupling slide mechanism to contact its control cam by a spring pretensioning element. In this way, a switching command on the respective shaft part (segment-by-segment rotation) can be realized for all allocated cam followers independent of their instantaneous cam lift position. Only if the relevant cam follower is located in the cam root circle mode and this cam follower is thus no longer tensioned will the pretensioned coupling slide be displaced abruptly into its desired position.

In a refinement of this arrangement, the coupling slide mechanism can consist of two components that are spring mounted away from each other. For example, the actual coupling slide can be provided on the ends with a simple torque control spring.

DETAILED DESCRIPTION

Figure 1:
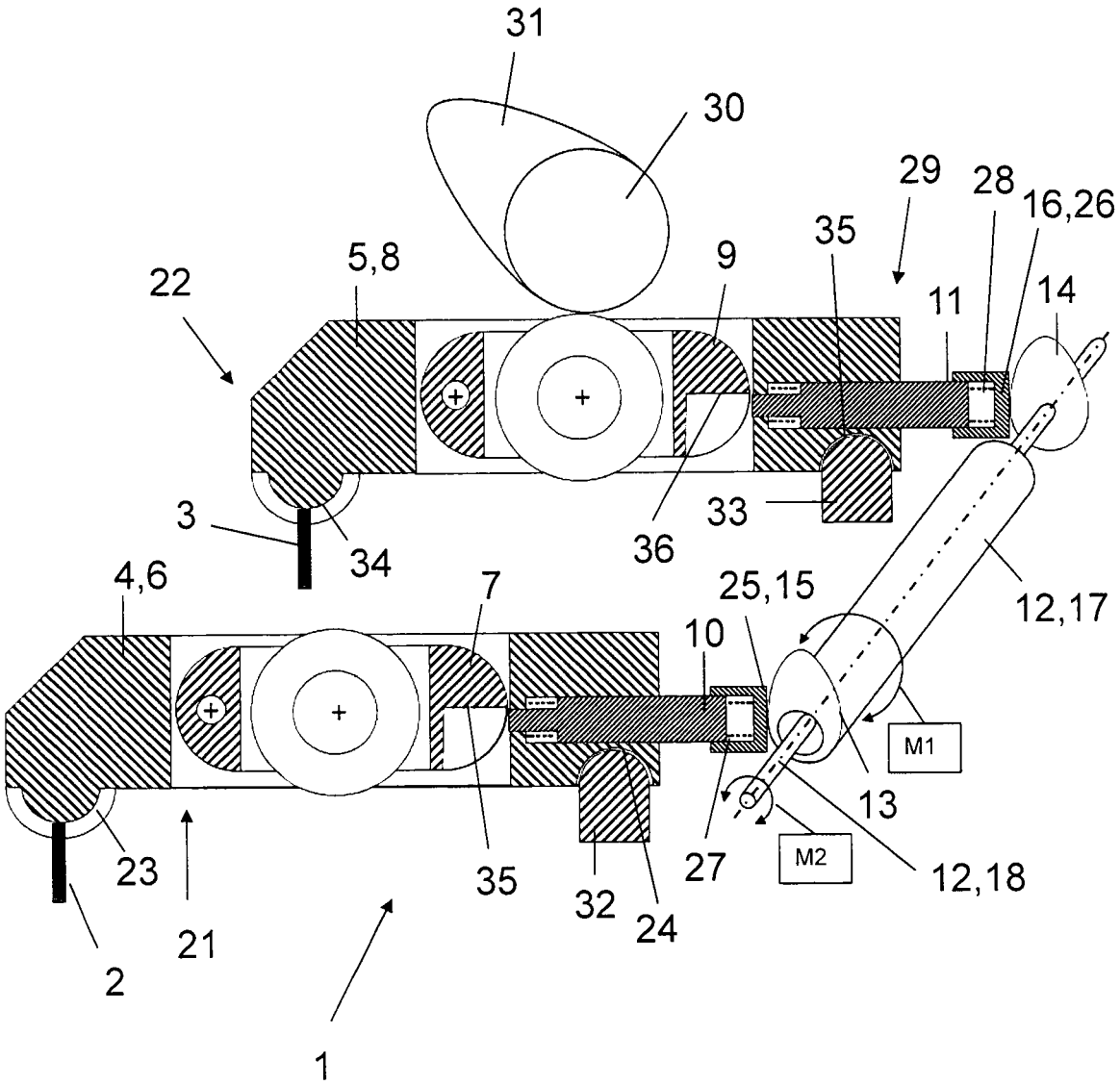
FIG. 1 shows a schematic view of a variable finger lever drive.

From FIG. 1, a lift-variable valve train 1 of a combustion engine for loading two equally acting gas exchange valves 2, 3 of a cylinder of the combustion engine can be seen.

A switchable valve train element 4, 5 that is here provided as a finger lever that can be disconnected is allocated to each gas exchange valve 2, 3. Each valve train element 4, 5 has an elongated outer part 6, 8 as the main finger lever arm. A pawl-like inner part 7, 9 that can be disconnected relative to the outer part is held in a space of the outer part as a secondary finger lever arm that has a pivot center on the side of one end 22.

Each outer part 6, 8 acts with a lifting function on a bottom side 21 on the end 22 by a valve contact 23, 34 on its gas exchange valve 2, 3. On the other end 29, each outer part 6, 8 has a spherical cap-shaped pivot bearing 24, 35. By this bearing it is supported on a support element 32, 33 that is a mechanical or hydraulic part.

Above each pivot bearing 24, 35, the respective outer part 6, 8 has a coupling slide mechanism 10, 11 that is provided as a pin and can be moved longitudinally in the finger lever arm direction. As can be seen, the latter protrudes from the outer part 6, 8 with its outer end face 15, 16. The two coupling slide mechanisms 10, 11 are shown in their retracted position, i.e., disengaged from an engagement surface 35, 36 on the free pivot end of the inner part 7, 9. In this way, the cam lift is deactivated and both gas exchange valves remain closed, as can be provided according to the use of the valve train 1 if residual gas recirculation is not desired or if the cylinder is deactivated.

In addition, the valve train 1 includes a control shaft 12 that runs parallel to a camshaft 30, with a cam lift 31 extending from this camshaft 30, for example, in contact with the here rear valve train element 5, more exactly stated, its inner part 9. The control shaft 12 is formed of two shaft parts 17, 18 that are built concentrically one inside the other and can each rotate individually by a separate servo mechanism M1, M2. An electric rotary actuator can be provided as each servo mechanism M1, M2.

Figure 2:
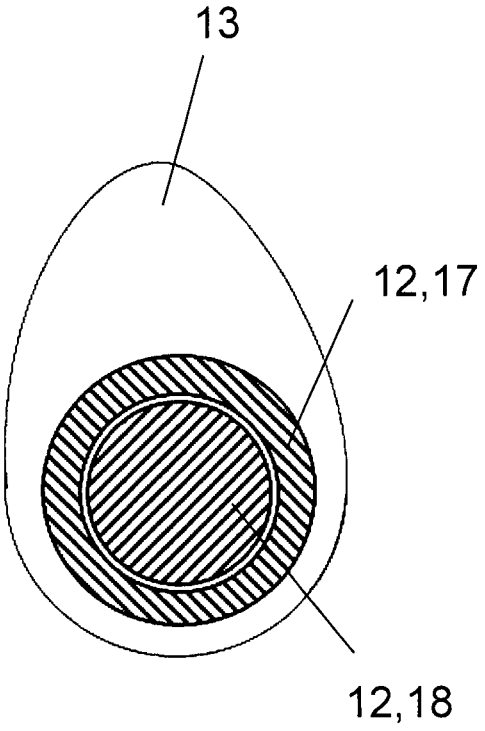
FIG. 2 shows a cross section through the control shaft in longitudinal section of the cam connected to the "outer" shaft section.

FIG. 1 shows that a control cam 13 sits rigidly on the outer shaft part 17 (see also FIG. 2). This is in contact with the outer end face 15 of the coupling slide mechanism 10 of the first valve train element 4 shown in the foreground.

Figure 3:
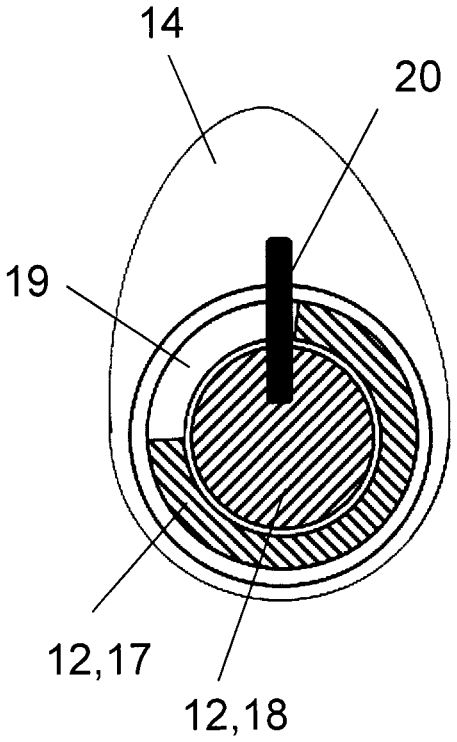
FIG. 3 shows a cross section through the control shaft in longitudinal section of the cam connected to the "inner" shaft section.

A control cam 14 that contacts the outer end face 16 of the coupling slide mechanism 11 of the here "rear" valve train element 5 is connected to the inner shaft part 18. The exact type of connection of this control cam 14 can be seen in FIG. 3. Accordingly, the control cam 14 is likewise on the outer shaft part 17 but can rotate relative to this part. It is actuated by a radial finger 20 protruding from the inner shaft part 18 and extending through a segment-like slot 19 of the outer shaft part 17.

From FIG. 1 it can also be seen that the two coupling slide mechanisms 10, 11 contact their control cams 13, 14 in an elastically pretensioned way. For realizing the pretensioning for the respective coupling slide mechanism 10, 11, on the outer end face, a pressure cap 25, 26 is applied that is loaded by a spiral compression spring as compression spring mechanism 27, 28 away from the coupling slide mechanism 10, 11. The respective pressure cap 25, 26 directly contacts the respective control cam 13, 14. In this way, the respective coupling slide mechanism 10, 11 can be "pretensioned" by the control cam 13, 14 outside of a cam root circle contact.

The two valve train elements 4, 5 can be switched independently of each other, so that a total of 3 or 4 total gas exchange cross sections can be produced for each cylinder of the combustion engine. For example, by a segment-by-segment rotation of just the control shaft 17 using the electrical rotary actuator M1, only the coupling slide mechanism 10 can be moved mechanically, so that, stated briefly, the inner part 7 of the front valve train element 4 is coupled and this performs a lift on the gas exchange valve 2 when the gas exchange valve 3 is deactivated.

Four total gas exchange cross sections are then produced if the inner parts 7, 8 of the valve train elements 4, 5 configured here as finger levers that can be disconnected are loaded by cams with different cam lift profiles with respect to each other, which then makes a specially prepared camshaft necessary.

It is also conceivable and provided to construct one of the valve train elements 4, 5 as an element that can be disconnected (only one cam per valve train element) and the other as a switchable element (two cams for each valve train element (large cam lift, small cam lift)) or to construct both as switchable elements. Altogether, what is important is the ability to individually actuate the valve train elements 4, 5 of a cylinder of the combustion engine.

LIST OF REFERENCE NUMBERS AND SYMBOLS

1) Valve train
2) Gas exchange valve
3) Gas exchange valve
4) Valve train element
5) Valve train element
6) Outer part
7) Inner part
8) Outer part
9) Inner part
10) Coupling slide mechanism
11) Coupling slide mechanism
12) Control shaft
13) Control cam
14) Control cam
15) Outer end face
16) Outer end face
17) Shaft part
18) Shaft part
19) Slot
20) Radial finger
21) Bottom side
22) One end
23) Valve contact
24) Pivot bearing
25) Pressure cap
26) Pressure cap
27) Compression spring mechanism
28) Compression spring mechanism
29) Other end
30) Camshaft
31) Cam lobe
32) Support element
33) Support element
34) Valve contact
35) Engagement surface
36) Engagement surface
M1) Servo mechanism
M2) Servo mechanism

The invention claimed is:

1. A variable valve train of an internal combustion engine for applying a load on two equally acting gas exchange valves for each cylinder of the internal combustion engine, the variable valve train comprising:

two switchable valve train elements, each having an outer part and inner part that can move relative to each other, one of the switchable valve train elements respectively allocated at least indirectly to each one of the two gas exchange valves;

two coupling slide mechanisms, one associated with each of the switchable valve train elements, that selectively connect the outer part and the inner part to each other so that when the outer part and the inner part are coupled together, a large travel is provided, and when the outer part and the inner part are decoupled a relatively smaller or zero travel of the gas exchange valve is realized;

a common control shaft including first and second shaft parts and having two control cams, one for each said coupling slide mechanism, each said control cam at least indirectly contacts a respective outer end face of the coupling slide mechanism associated therewith for displacement in one direction, and said control cams are rotatable separately from each other on the common control shaft; and a first servo mechanism and a second servo mechanism each formed as rotary actuators or pivoting actuators, the first and second servo mechanisms each apply a load to each of the shaft parts, the first and second servo mechanisms are electrically or hydraulically actuatable, the first servo mechanism contacts an end face of the respective shaft part, and the second servo mechanism contacts a middle area of the respective shaft part, the middle area being defined between the two control cams.

2. The valve train according to claim 1, wherein the two shaft parts are built concentrically one inside the other and each is rotatable by a respective one of the first and second servo mechanisms, and each of the shaft parts is in a rotationally locked connection with a respective one of the control cams.

3. The valve train according to claim 2, wherein the two control cams both sit on the outer shaft part, one of the control cams is directly locked in rotation with the outer shaft part and the other of the control cams is fixed in an axial direction and rotatable on the outer shaft part, said other control cam is locked in rotation with a radial finger protruding from the inner shaft part and extending through a slot in the outer shaft part.

4. The valve train according to claim 1, wherein the switchable valve train elements comprise finger levers, and for each of the finger levers, the outer part forms a main finger lever arm and has, on a bottom side thereof, an at least indirect valve contact on one end and a pivot bearing for a support element on an other end, the inner part forms a secondary finger lever arm having a pawl-shaped profile having one end connected in an articulated manner to the outer part, and the coupling slide mechanism includes a coupling pin in the outer part located on the other end, with said pin protruding from the outer part with the outer end face thereof.

5. The valve train according to claim 1, wherein each said coupling slide mechanism contacts the associated control cam in an elastically pretensioned manner.

6. The valve train according to claim 5, further comprising a pressure cap preassembled on each said coupling slide mechanism to provide the pretensioning for each said coupling slide mechanism, the pressure cap is loaded by a compression spring away from the coupling slide mechanism and directly contacts the control cam.

7. The valve train according to claim 1, further comprising an elastic pretensioning element for each said coupling slide mechanism that biases the respective coupling slide member against the associated control cam.

8. The valve train according to claim 7, wherein the elastic pretensioning element includes a pressure cap loaded by a compression spring away from the coupling slide mechanism that directly contacts the control cam.

9. A variable valve train of an internal combustion engine for applying a load on two gas exchange valves for each cylinder of the internal combustion engine, the variable valve train comprising:

first and second switchable valve train elements, each of the switchable valve train elements including:

an outer part;

inner part that can move relative to the outer part;

a coupling slide mechanism that selectively connects the outer part and the inner part so that when the outer part and the inner part are coupled together, a large travel is provided, and when the outer part and the inner part are decoupled a relatively smaller or zero travel of the gas exchange valve is realized;

a common control shaft including first and second shaft parts and having two control cams, one for each said coupling slide mechanism, each said control cam acts on a respective outer end face of the coupling slide mechanism associated therewith for displacement in one direction, and said control cams are rotatable separately from each other on the common control shaft, a first servo mechanism and a second servo mechanism each formed as rotary actuators or pivoting actuators, the first and second servo mechanisms each apply a load to each of the shaft parts, the first and second servo mechanisms are electrically or hydraulically actuatable, the first servo mechanism contacts an end face of the respective shaft part, and the second servo mechanism contacts a middle area of the respective shaft part, the middle area being defined between the two control cams.

10. The valve train according to claim 9, wherein the first and second shaft parts that are built concentrically one inside the other.

11. The valve train according to claim 9, wherein the first and second control cams are located on the outer shaft part, the first control cam is locked in rotation with the outer shaft part, and the second control cam is axially fixed and rotatable on the outer shaft part and locked in rotation with a radial finger protruding from the inner shaft part that extends through a slot in the outer shaft part.

12. The valve train according to claim 9, wherein the switchable valve train elements comprise finger levers, and for each of the finger levers, the outer part forms a main finger lever arm and has, on a bottom side thereof, an at least indirect valve contact on one end and a pivot bearing for a support element on an other end, the inner part forms a secondary finger lever arm having a pawl-shaped profile having one end connected in an articulated manner to the outer part, and the coupling slide mechanism includes a coupling pin in the outer part located on the other end, with said pin protruding from the outer part with the outer end face thereof.

* * * * *